US005304402A

United States Patent [19]

Nishida et al.

[11] Patent Number: 5,304,402

[45] Date of Patent: Apr. 19, 1994

[54] CURTAIN COATING METHOD WITH REDUCED NECK-IN

[75] Inventors: Shouji Nishida; Yoshinobu Katagiri; Yasushi Suga, all of Kanagawa, Japan

[73] Assignee: Fuji Photo Film Co., Ltd., Kanagawa, Japan

[21] Appl. No.: 889,922

[22] Filed: Jun. 2, 1992

[30] Foreign Application Priority Data

Jun. 3, 1991 [JP] Japan ..... 3-157430

[51] Int. Cl.[5] ..... B05D 1/30

[52] U.S. Cl. ..... 427/420; 118/324; 118/DIG. 4

[58] Field of Search ..... 427/420; 118/DIG. 4, 118/324

[56] References Cited

U.S. PATENT DOCUMENTS

| | | | |
|---|---|---|---|
| 3,632,403 | 12/1969 | Greiller | 118/DIG. 4 |
| 4,135,477 | 1/1979 | Ridley | 118/325 |
| 4,944,533 | 12/1990 | Ishizuka et al. | 118/411 |

FOREIGN PATENT DOCUMENTS

| | | |
|---|---|---|
| 0115621 | 12/1983 | European Pat. Off. . |
| 0327020 | 1/1989 | European Pat. Off. . |
| 8910583 | 11/1989 | European Pat. Off. . |
| 0383347 | 2/1990 | European Pat. Off. . |
| 0426122 | 10/1990 | European Pat. Off. . |
| 61-245862 | 11/1986 | Japan . |
| 2-216139 | 8/1990 | Japan . |

OTHER PUBLICATIONS

J. Fluid Mech. (1981), vol. 112, pp. 443–458–"Waves in a Viscous Liquid Curtain".

*Primary Examiner*—Shrive Beck
*Assistant Examiner*—Katherine A. Bareford
*Attorney, Agent, or Firm*—Sughrue, Mion, Zinn, Macpeak & Seas

[57] ABSTRACT

A film applying method in which a coating solution is applied by a solution injector having an edge guide onto a support member as a freely falling coating film, includes forming a solution contact surface of the edge guide to have one of a radius greater than 1.0 mm or a width d greater than 0.7 mm when the coating solution has at least one of a viscosity greater than 45 cp and a dynamic surface tension difference greater than 8 dyne/cm. The edge guide solution contacting surface is narrowed to have a radius less than 1.0 mm or a width d less than 0.7 mm when the coating solution has at least one of a viscosity less than 45 cp and a dynamic surface tension difference less than 8. In a second embodiment, the coating solution is prepared to have at least one of a viscosity greater than 45 cp and a dynamic surface tension difference greater than 8 dyne/cm when the solution contacting part of the edge guide has either a radius r greater than 1.0 mm or a width d greater than 0.7 mm. Alternatively, the coating solution is prepared to have at least one of a viscosity less than 45 cp and a dynamic surface tension difference less than 8 dyne/cm when the solution contacting part of the edge guide has either a radius r less than 1.0 mm or a width d less than 0.7 mm.

7 Claims, 2 Drawing Sheets

CURTAIN COATING METHOD WITH REDUCED NECK-IN

BACKGROUND OF THE INVENTION

The present invention relates to a coating method, and more particularly to a curtain-film type coating method which is used to apply a photographic layer (for example, a photosensitive silver halide emulsion layer) of a photographic material.

As a curtain-film coating method of applying a photographic layer of a photographic material, there have been disclosed a method in which a guide rod is moved in the width direction of a freely falling curtain of coating film (see U.S. Pat. No. 3,632,403), a method in which the width of a contact surface between a guide rod and a freely falling curtain of coating film is made to correspond to the thickness of the freely falling coating film (see Japanese Patent Publication No. Sho. 61-245862), and other methods.

However, according to the first conventional method mentioned above, a problem arises in that the freely falling curtain of coating film cannot be stabilized, thereby causing a "neck-in" (e.g., a coating solution leaves an edge guide at the two ends of the falling curtain of coating film, and the falling of coating film results in being narrow in the width direction) to occur at a position located above the lower end of an edge guide.

In the second conventional method, although the formation a thick coating is minimized in portions on the film near the two ends of the coating film, formation of a thick coating inwardly of this portion and formation of a thick coating in the inside portion (e.g., a central portion) of the film in the width direction thereof still cannot be prevented.

That is, in the conventional curtain-film coating method, due to the above-mentioned poorly coated portion of the film and increased thickness of the second-mentioned thick coating, a wider, unevenly coated portion is often produced at the two ends of the film in the film coating direction (e.g., in the film width direction) as compared to other film coating methods.

SUMMARY OF THE INVENTION

The present invention is directed to eliminating the drawbacks found in the above-mentioned film coating methods. Accordingly, it is an object of the invention to provide a film coating method which can prevent a neck-in of a coating solution from forming at a position above the lower end of a guide rod for a freely falling curtain of coating film to thereby uniformly distribute the coating film at the two ends thereof in the film coating direction.

The above-mentioned object of the invention can be achieved by a first curtain-film coating method for applying a coating solution from a solution injector having the coating solution supported at the two side ends thereof by an edge guide to apply the coating solution onto a support member as a freely falling curtain of coating film, wherein the solution contacting surface of the edge guide is formed to have a radius $r>1.0$ mm or a width $d>0.7$ mm when the coating solution has a viscosity $\mu>45$ cp and/or has a dynamic surface tension difference $\Delta\sigma>8$ dyne/cm, and the edge guide solution contacting surface is narrowed to provide a radius $r<1.0$ mm or a width $d<0.7$ mm when the coating solution has a viscosity $\mu<45$ cp and/or has a dynamic surface tension difference $\Delta\sigma<8$ dyne/cm.

Further, according to the invention, a second curtain-film coating method is provided for applying a coating solution using a solution injector having an edge guide for supporting the coating solution at the two side ends thereof to apply the coating solution onto a support member as a freely falling curtain of coating film, wherein the coating solution has a viscosity $\mu>45$ cp and/or has a dynamic surface tension difference $\Delta\sigma>8$ dyne/cm when the solution contacting part of the edge guide has $r>1.0$ mm or $d>0.7$ mm, and the coating solution is prepared to have a viscosity $\mu<45$ cp and/or has a dynamic surface tension difference $\Delta\sigma<8$ dyne/cm when the edge guide solution contacting part has a radius $r<1.0$ mm or width $d<0.7$ mm.

According to the invention, the term "solution contacting part" refers to an element or a component of the edge guide, and the term "solution contacting surface" means an actual surface to be provided when the solution contacting part is in contact with the coating solution to be applied.

To clarify the underlying concept of the present invention, it is noted that operational principles other than those of the present invention can be used. For example, a method disclosed in U.S. Pat. No. 4,974,533, which is injecting a coating solution having a low viscosity little by little along the contacting solution coating surface of the edge guide, is used together with the method of the present invention, thereby achieving the better effect.

Additionally, when an edge guide having a wide solution contacting surface with a small curvature is used, a similar result can be obtained similarly to that when the solution contacting surface is narrow.

According to the invention, the term "dynamic/static surface tension difference $\Delta\sigma$" can be expressed by the following equation:

$$\Delta\sigma=\sigma_{dynamic}-\sigma_{static}$$

In other words, a static surface tension occurs in the film end portions, and a dynamic surface tension occurs in the central portion of the film coating.

Generally, the coating solution contains a surface active agent. When the surface active agent is attached to and oriented on the surface of the coating solution, the surface active agent reduces the surface tension of the coating solution. In the curtain-film application, when the coating solution is ejected from the ejector through a slit and is free from the lip of the solution injector, a vapor-liquid surface is produced so that the surface tension of the coating solution is decreased as it moves downstream. This surface tension is referred to as a "dynamic surface tension." Additionally, the coating solution is assumed to be stationary on the guide bar in the film end portion in terms of hydrodynamics, and thus the surface tension at the film end portions can be assumed to have a "static surface tension."

Under the above conditions, in the central portion of the curtain coating film a surface tension difference $\Delta\sigma$ is produced in the width direction of the coating film.

When measuring the dynamic/static surface tension difference (i.e. the difference between dynamic and static surface tensions):

(1) the static surface tension is measured according to a so-called plate method; and (2) the dynamic surface tension is measured according to a method disclosed in J. Fluid Mech., (1981), vol.

112, pp. 443–458, as well as in Japanese Patent Publication No. Hei. 2-216139. This method is performed as discussed below.

Specifically, as shown in FIG. 3(B), a measuring solution 32 is allowed to fall from a solution injector 31, and a coating solution film 34 is formed by an edge guide 33. A pin 35 can be inserted into a position H which is centrally located on the coating film, so that the coating film produces a solution turbulence having an angle $\theta$. Based on the turbulence angle $\theta$, flow quantity for unit width Q, and the like, the dynamic surface tension $\sigma$ can be found according to the following equation:

$$\sigma = \frac{1}{2} \cdot \rho \cdot Q \cdot U \cdot \sin^2 \theta$$

$$U^2 = U_0^2 + 2gH$$

$$U_0 = (Q^2 \rho g / 3\mu)^{\frac{1}{3}}$$

where U is a flow rate at a point to be measured, $U_0$ is an initial velocity, H is the height of the curtain, $\rho$ is the density of the liquid, and g is the acceleration of gravity.

In the invention, the measurement was conducted with the height of the curtain H of 50 mm.

BRIEF DESCRIPTION OF THE DRAWINGS

FIG. 3(A) is a front view of a boundary layer of a freely falling coating film, and FIG. 3(B) is a perspective view of a method of measuring a dynamic surface tension difference of the film coating.

DESCRIPTION OF THE PREFERRED EMBODIMENTS

Figure 3A:
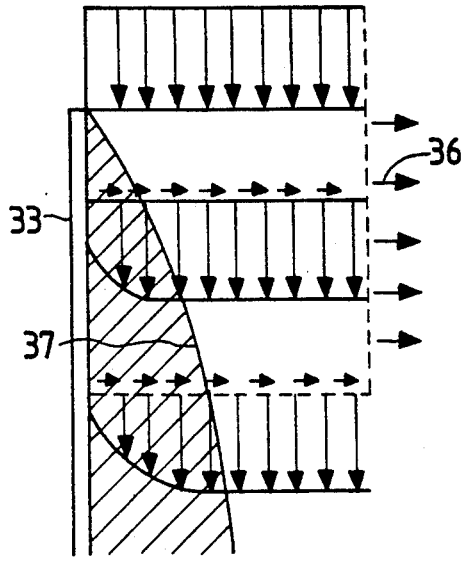
FIGS. 3(A) and 3(B) are explanatory views of the principles of the invention, and more particularly
Figure 3B:
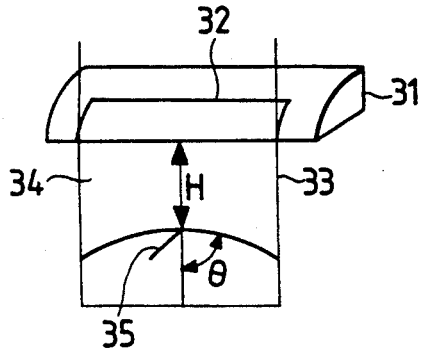

According to the inventors, study of the conventional curtain film coating methods, as shown in FIG. 3(A) it has been determined that the uneven film coating in the two end portions of the coating film in the width direction thereof according to the conventional curtain-film coating methods is caused by the horizontal movement 36 of the coating solution in the freely falling coating film.

Further, the development of a boundary layer 37 caused by fluid friction in the edge guide 33 moves the coating solution, which is present near the coating film end portions, in the width direction and in the central direction of the coating film. Additionally, the dynamic/static surface tension difference between the steady flow portions, which are respectively present in the adjacent and central portions of the edge guide, of the surface active agent contained in the coating solution similarly causes the coating solution to move in the width direction and in the central direction of the coating film. Still further, if the coating solution assumes a concave-lens shape or a meniscus-lens shape on the edge guide facing toward the vapor phase, the coating solution will be moved from the central portion toward the two end portions of the edge guide.

From the above-mentioned determination, the horizontal movement of the coating solution can be restricted by balancing the development of the boundary layer, the tendency of the coating solution to move in the width and central directions of the coating film caused by the dynamic/static surface tension difference, and the tendency of the coating solution to move toward the two end portions of the edge guide caused by the concave-lens or meniscus shape which the coating solution forms thereat, thereby preventing the coating film from having an uneven thickness near the two ends thereof.

Simultaneously, the inventors' study has also found that when the horizontal velocity of the coating solution is great, neck-in tends to form in the middle of the edge guide. Conversely, if the horizontal velocity is decreased, then the film can be formed more easily.

With respect to the boundary layer mentioned above, generally a coating solution has a predetermined viscosity, and therefore when the coating solution flow is in contact with a solid wall, the coating solution flow velocity is zero on the solid wall. Thus, near the solid wall an area is produced at which the coating solution has a velocity gradient, this area being the boundary layer. In the curtain-film coating method, the coating solution is assumed to have a uniform velocity in most areas because it falls freely. However, in the two end portions of the coating solution adjacent to the edge guide, a boundary layer develops, and thus a velocity gradient is produced. Additionally, the boundary layer increases in width as it moves downstream. At that time, a horizontal flow (e.g., a flow moving in a direction from the edge guide toward the central portion of the coating film) occurs. This can also be shown according to the Navier-Stokes equation.

INVENTIVE EXAMPLE 1

Figure 1A:
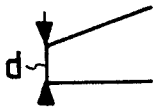
FIGS. 1(A), 1(B) and 1(C) are explanatory views of first, second, and third embodiments, respectively, of a section of the leading end portion of an edge guide used in the invention.
Figure 1C:
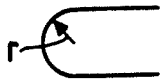
Figure 2A:
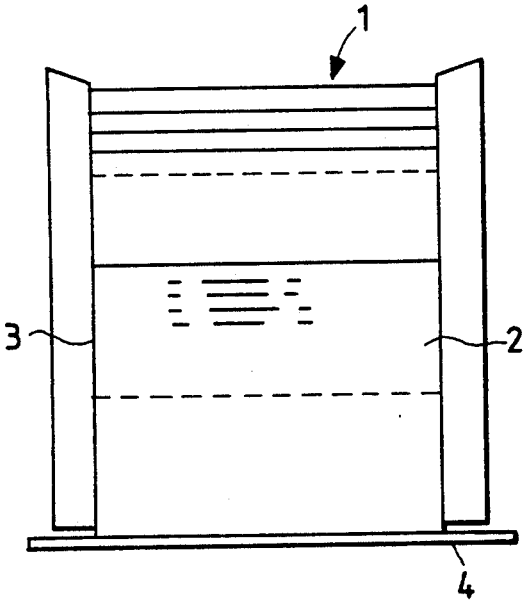
FIG. 2(A) is a front view of an embodiment of a curtain-film coating device used in the invention.
Figure 2B:
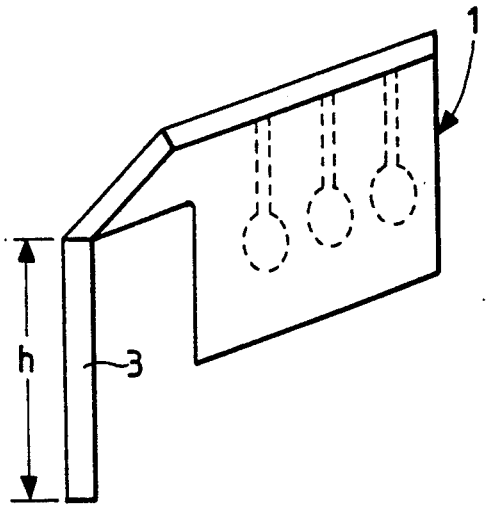
FIG. 2(B) is a side view of the embodiment of FIG. 2(A)

In this embodiment, a coating solution containing a gelatin water solution (14.5% by weight) having a viscosity $\mu$ of 65 cp and containing 30 cc/l of $\alpha$-sulfosuccinic acid 2-ethyl hexyl ester sodium (diethyl hexyl sulfosuccinate (Na)) as a surface active agent was applied onto a support member 4 along an edge guide 3 as 4 cc/(cm·sec) of freely falling coating film 2 using a curtain-film coating device 1 as shown in FIGS. 2(A) and 2(B). Particularly, in this embodiment, when an edge guide 3 having a section as shown in FIG. 1(C) with a radius r of 2 mm, the film thickness distribution of the end portions in the coating solution application width direction could be suitably controlled without producing any neck-in down to the lower end of the edge guide solution contacting portion having a height h of 140 mm, so that the coating film could be formed uniformly. The edge guide has a sectional figure as shown in FIG. 1(C) at any position.

COMPARATIVE EXAMPLE 1

Figure 1B:
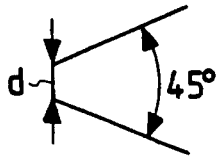

Under the above-mentioned solution applying conditions, when an edge guide 3 formed as shown in FIG. 1(B) with a width d=0.5 mm and an opening angle of 45° there was produced a neck-in at a position located at a height h of 23 mm down from the top of the solution contacting portion of the edge guide. The edge guide has a sectional figure as shown in FIG. 9(B) at any position.

INVENTIVE EXAMPLE 2

In this embodiment, a gelatin water solution (10% by weight) having a viscosity $\mu$ of 25 cp and, as a surface active agent, 30 cc/l of $\alpha$-sulfosuccinic acid 2-ethyl hexyl ester sodium (diethyl hexyl sulfosuccinate (Na)) were mixed to prepare a coating solution. Then, the coating solution having a dynamic/static surface tension difference $\Delta\sigma$ of 3 dyne/cm was applied to a support member 4 as 4 cc/(cm·sec of freely falling coating film by using a curtain-film coating device 1, as shown in FIGS. 2(A) and 2(B). In this coating solution application, an edge guide similar to that used in Comparative Example 1 was used, and the film thickness distribution of the end portions in the coating solution application width direction were suitably controlled without producing any neck-in down to the lower end of the edge guide solution contacting portion having a height h of 140 mm, so that the coating film could be formed uniformly.

INVENTIVE EXAMPLE 3

In this embodiment, a gelatin water solution (10% by weight) having a viscosity $\sigma=27$ cp and, as a surface active agent, 30 cc/l of polystyrene sulfonic acid sodium (dodecylbenzenesulfonic acid sodium) were mixed to prepare a film coating solution, and then the coating solution having a dynamic surface tension difference $\Delta\sigma=12$ dyne/cm was applied in an amount of 4 cc/(cm·sec) to a support member by using a curtain-film coating device, as shown in FIGS. 2(A) and 2(B). Particularly, in this coating solution application, an edge guide 3 having a shape similar to that used in Example 1 was used, so that the film thickness distribution of the end portions in the coating solution application width direction could be suitably controlled without producing any neck-in down to the lower end of the edge guide solution contacting portion having a height h of 140 mm. Thus, the coating film can be formed uniformly.

COMPARATIVE EXAMPLE 2

In this case, the same coating solution was applied using an edge guide having a narrow contacting surface similar to that of Comparative Example 1, which resulted in a neck-in being produced at a position located 30 mm down from the top of the solution contacting part of the edge guide.

INVENTIVE EXAMPLE 4

In this embodiment, a gelatin water solution (14.5% by weight) having a viscosity $\mu$ of 67 cp and, as a surface active agent, 30 cc/l of polystyrene sulfonic acid sodium (dodecylbenzenesulfonic acid sodium) were mixed to prepare a coating solution. Then, 2 cc/(cm·sec) of the thus-prepared coating solution was applied using an edge guide shown in FIG. 1(A) having a width d of 1 mm, while a gelatin 2% solution containing a water:methanol ratio of 7:3 was allowed to flow along the edge guide as a low-viscosity solution. In this embodiment, no neck-in was produced down to the lower end of the solution contact part of the edge guide having a height h of 100 mm, and thus the coating solution could be applied desirably. The edge guide has a sectional figure as shown in FIG. 1(A) at any position.

COMPARATIVE EXAMPLE 3

In this case, under the same coating solution conditions as in Example 4, the coating solution having a viscosity $\mu$ of 56 cp was applied by using an edge guide identical to that of Example 4 without using the low-viscosity solution flowing along the edge guide. In this case, a neck-in occurred at a position h located 25 mm down from the top of the solution contacting part of the edge guide, and the thickness distribution of the coating film formed was poor.

The film coating method according to the invention can form stably a freely falling coating film and can reduce the variations in the film thickness distribution of the two end portions of a film forming layer, thereby forming uniformly the coating film. Additionally, the quality and reliability of the coating film formed can be improved.

Although the present invention has been fully described by way of preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A curtain-film coating method for applying a coating solution onto a support member, said method comprising the steps of:

providing a solution injector having at two side ends thereof an edge guide for supporting the coating solution to apply the coating solution onto said support member as a freely falling curtain of coating film; and forming a solution contacting surface of said edge guide to have one of a radius r greater than 1.0 mm and a width d greater than 0.7 mm when said coating solution has at least one of a viscosity $\mu$ greater than 45 cp and a dynamic/static surface tension difference $\Delta\sigma$ greater than 8 dyne/cm, wherein said solution contacting surface is narrowed to have a radius r less than 1.0 mm or a width d less than 0.7 mm when said coating solution has at least one of a viscosity less than 45 cp and a dynamic/-static surface tension difference $\Delta\sigma$ less than 8 dyne/cm.

2. The method according to claim 1, further comprising applying 2 cc/(cm·sec) of the coating solution by using an edge guide having a width d of 1 mm, and flowing a gelatin 2% solution containing a water:methanol ratio of 7:3 along the edge guide as an auxiliary liquid.

3. A curtain-film coating method for applying a coating solution onto a support member, said method comprising the steps of:

providing a solution injector having at first and second ends thereof an edge guide for supporting the coating solution to apply the coating solution onto said support member as a freely falling curtain of coating film, said edge guide having a solution contacting part; and preparing said coating solution to have at least one of a viscosity $\mu$ greater than 45 cp and a dynamic/-static surface tension difference $\Delta\sigma$ greater than 8 dyne/cm when the solution contacting part of said edge guide has one of a radius r greater than 1.0 mm and a width d greater than 0.7 mm, wherein said coating solution is prepared to have at least one of a viscosity $\mu$ less than 45 cp and a dynamic/static surface tension difference $\Delta\sigma$ less than 8 dyne/cm when said edge guide solution contacting part has one of a radius r less than 1.0 mm and a width d less than 0.7 mm.

4. The method according to claim 3, wherein said coating solution comprises a gelatin water solution having a viscosity $\mu$ of 25 cp and contains a surface active agent comprising 30 cc/l of $\alpha$-sulfosuccinic acid 2-ethyl hexyl ester sodium mixed to form the coating solution.

5. The method according to claim 3, wherein said coating solution comprises a gelatin water solution having a viscosity of 27 cp and contains 30 cc/l of polystyrene sulfonic acid sodium.

6. The method according to claim 3, wherein said coating solution comprises a gelatin water solution having a viscosity of 67 cp and contains 30 cc/l of polystyrene sulfonic acid sodium.

7. The method according to claim 3, further comprising applying 2 cc/(cm·sec) of the coating solution by using an edge guide having a width d of 1 mm and flowing a gelatin 2% solution having a water:methanol ratio of 7:3 along the edge guide as an auxiliary liquid.

* * * * *